US005886346A

United States Patent [19]

Makarov

[11] Patent Number: 5,886,346

[45] Date of Patent: Mar. 23, 1999

[54] MASS SPECTROMETER

[75] Inventor: Alexander Alekseevich Makarov, Manchester, United Kingdom

[73] Assignee: HD Technologies Limited, Manchester, United Kingdom

[21] Appl. No.: 930,568

[22] PCT Filed: Mar. 29, 1996

[86] PCT No.: PCT/GB96/00740

§ 371 Date: Sep. 29, 1997

§ 102(e) Date: Sep. 29, 1997

[87] PCT Pub. No.: WO96/30930

PCT Pub. Date: Oct. 3, 1996

[30] Foreign Application Priority Data

Mar. 31, 1995 [GB] United Kingdom ..... 9506695

[51] Int. Cl.[6] ..... H01J 49/42

[52] U.S. Cl. ..... 250/291; 250/290

[58] Field of Search ..... 250/291, 290, 250/292, 293, 295, 281, 282

[56] References Cited

U.S. PATENT DOCUMENTS 4,982,088 1/1991 Weitekamp ..... 250/291
5,528,031 6/1996 Franzen ..... 250/291

OTHER PUBLICATIONS

Blauth, E.W.: "Dynamic mass spectrometers", Elsevier Publishing Co., Amsterdam, 1966, 117–121.

*Primary Examiner*—Kiet T. Nguyen
*Attorney, Agent, or Firm*—Townsend and Townsend and Crew

[57] ABSTRACT

A mass spectrometer comprises an ion source (11), an ion injection arrangement (12), field generator defined by shaped electrodes (14, 16) and a detector (18) to detect ions. The electrodes (14, 16) are shaped so as to provide therebetween a field of substantially hyper-logarithmic form whereby ions can be trapped within a potential well of the field for analysis.

22 Claims, 5 Drawing Sheets

MASS SPECTROMETER

BACKGROUND OF THE INVENTION

1. Field of the Invention

This invention relates to improvements in or relating to a mass spectrometer and is more particularly concerned with a form of mass spectrometer which utilizes trapping of the ions to be analyzed.

2. Description of the Prior Art

Molecular or atomic weight of a substance is a useful characteristic which, if detected, can enable the substance to be identified. A mass spectrometer is a measuring instrument which can determine the molecular weight of a substance or other molecule introduced into it for analysis. Mass Spectrometers operate in a number of different ways, however the present invention is concerned particularly with mass spectrometers in which ions are trapped or confined within a particular region of space for analysis purposes. Known types of mass spectrometers of this type are the so-called "quadrupole ion trap" spectrometers and "ion cyclotron resonance" spectrometers.

Quadrupole ion trap mass spectrometers currently available use a three-dimensional quadrupole electric field which oscillates at radio frequencies to trap ions. The ions can then be ejected from the field selectively on the basis of mass/charge ratio enabling the device to operate as a mass spectrometer. This form of spectrometer can be produced relatively inexpensively and relatively small in size, making it a popular choice as a mass selective detector for gas chromatographs (GC-MS).

Ion cyclotron resonance (ICR) mass spectrometers currently available use a combination of an electric field and a very strong magnetic field to trap ions. The trapped ions spiral around the magnetic field lines with a frequency related to the mass of the ion. The ions are then excited such that the radii of their spiralling motion increases and as the radii increase the ions are arranged to pass close to a detector plate in which they induce image currents. The measured signal on these detector plates as a function of time is related to the number and frequencies (hence mass) of the ions. Conventional techniques such as Fourier transformation can be applied to the measured signal to obtain the component frequencies of the ions and hence produce a frequency (and hence mass) spectrum. This type of mass spectrometer is able to produce a very high degree of mass resolution.

However, there-are disadvantages associated with the known forms of mass spectrometer described above. For instance, while the quadrupole ion trap mass spectrometer can be constructed small and cheaply, the mass resolution and mass range obtained is not very high unless the analysis is carried out using very slow scanning. While this is adequate for gas chromatograph mass measurement, it limits the applicability to molecular weight molecules of a biochemical nature. Furthermore, with the ion cyclotron resonance mass spectrometer described above, in order to provide the high magnetic field necessary for the spectrometer to work efficiently, it is necessary to provide a super conducting magnet which in itself is very expensive. Furthermore, a super conducting magnet of the type necessary requires, with technology currently available, the use of liquid helium to cool it and as a continuous supply of this is required, it necessarily results in high running costs of the spectrometer due to the relatively high cost of liquid helium.

SUMMARY OF THE INVENTION

It is an object of the present invention to provide an improved mass spectrometer in which the high mass resolution associated with the ion cyclotron resonance mass spectrometer can be achieved in a small and relatively inexpensive mass spectrometer.

According to the present invention therefore there is provided a mass spectrometer comprising an ion source to produce ions to be analyzed, electric field generation means to produce an electric field within which said ions can be trapped and detection means to detect ions according to their mass/charge ratio wherein said electric field defines a potential well along an axis thereof and said ions are caused to be trapped within said potential well and to perform harmonic oscillations within said well along said axis, said ions having rotational motion in a plane substantially orthogonal to said axis.

Preferably said electric field produced by the electric field generation means is of substantially "hyper-logarithmic form".

With this arrangement it is possible to detect ion mass/charge ratio with a high degree of resolution in a simple and inexpensive manner.

DETAILED DESCRIPTION OF A PREFERRED EXEMPLARY EMBODIMENT

Figure 1:
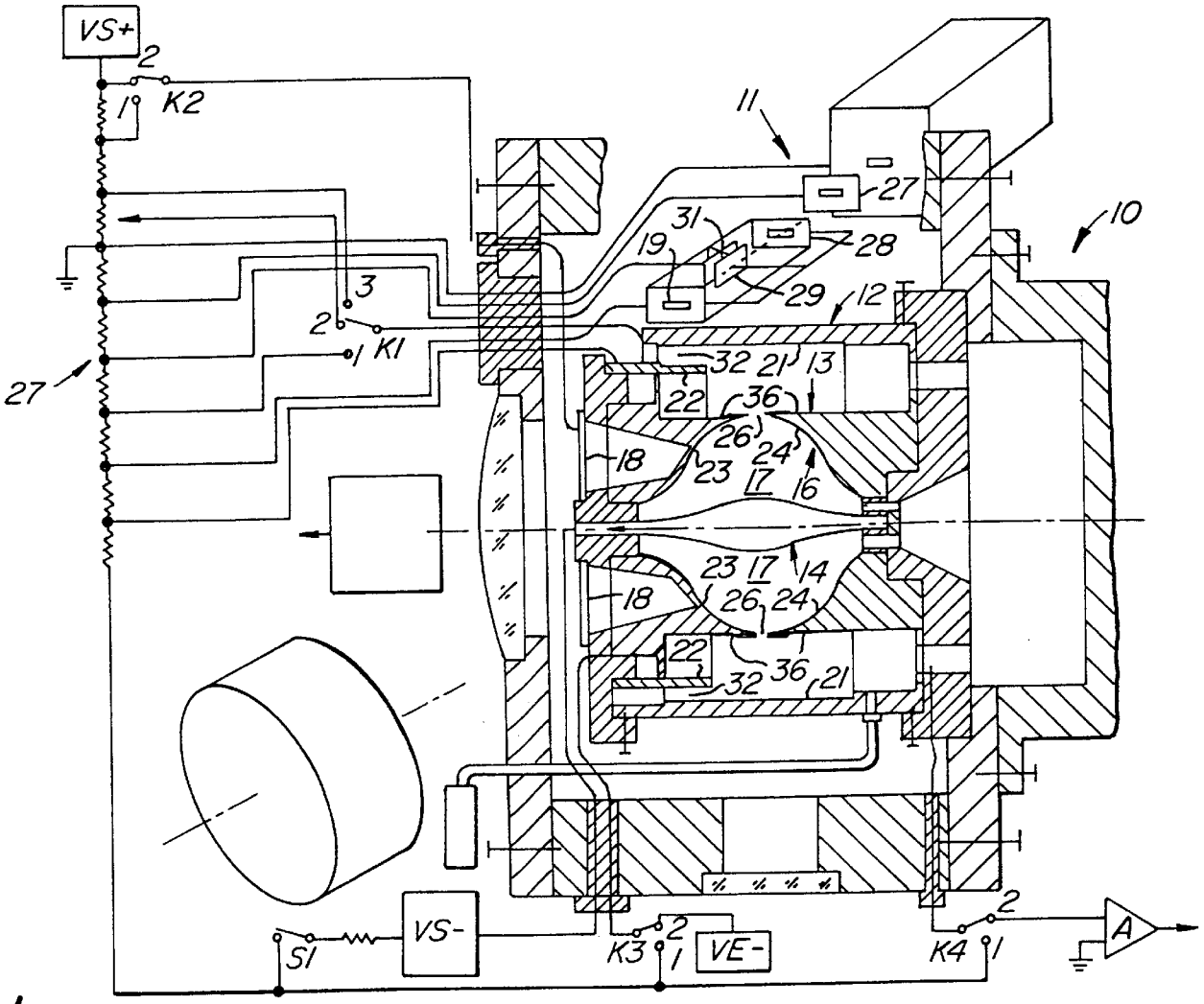
FIG. 1 is a schematic side view of one form of mass spectrometer according to the present invention.

Referring now to FIG. 1, there is shown a schematic representation of a mass spectrometer 10 which comprises an ion source 11, ion injection arrangement 12, field generator means 13 defined by the outer and inner shaped electrodes 14, 16 which define between them a measurement cavity 17 and one or more detectors 18 to detect the ions, either trapped in the field or ejected therefrom in a manner to be hereinafter defined The ion source 11 comprises either a continuous or pulsed ion-source of conventional type and produces an ion stream which exits through a slit 19 in a front part thereof.

Figure 3:
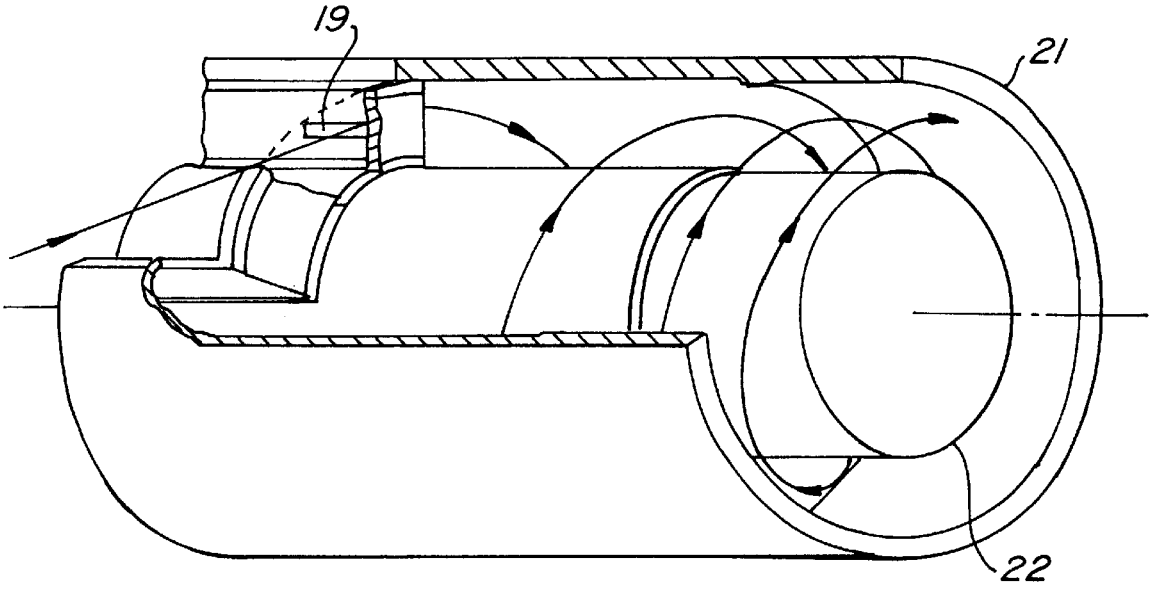
FIG. 3 shows a schematic view of a part of FIG. 1 to a larger scale showing part of one form of ion injection arrangement.

The ion injection arrangement 12 (shown more clearly in FIG. 3) comprises two concentric cylinder electrodes 21, 22, the outer electrode 21 being of substantially larger diameter than the inner electrode 22. The outer cylinder electrode 21 has a tangential hole through which ions from the source pass into the region between the outer and inner electrodes 21, 22. The injection arrangement 12 is mounted round the field generator means and is in connection therewith in a manner which will be described hereinafter. The outer cylindrical electrode 21 is stepped at ends thereof for a reason which will become hereinafter apparent. While in the embodiment described, the inner cylindrical electrode 22 is formed as a separate electrode, it is possible to use a top surface 36 of the shaped electrode 16 as indicated in FIG. 1 to form entirely the function as inner cylinder electrode 22.

The field generation arrangement 13 is disposed within the confines of inner cylinder electrode 22 and includes two shaped electrodes, internal and external field generator electrodes 14, 16 respectively. The space 17 between the internal and external shaped electrodes 14, 16 forms the measurement chamber. The electrodes 14, 16 are shaped for a reason which will become hereinafter apparent. The outer shaped electrode 16 is split into two parts 23, 24 by a circumferential gap 26, an excitation electrode part 23 and a detection electrode part 24. The circumferential gap 26 between the outer electrode parts 23, 24 allows ions to pass from the injection arrangement to the measurement chamber 17 in a manner to be hereinafter defined.

The cylindrical and shaped electrodes are connected to respective fixed voltage supplies via a potential divider arrangement 27 which allows a desired voltage to be applied to the electrodes.

The measurement chamber 17 is linked to a vacuum pump which operates to evacuate the measurement chamber to a UHV of approximately $10^{-8}$ Torr or lower.

Figure 2:
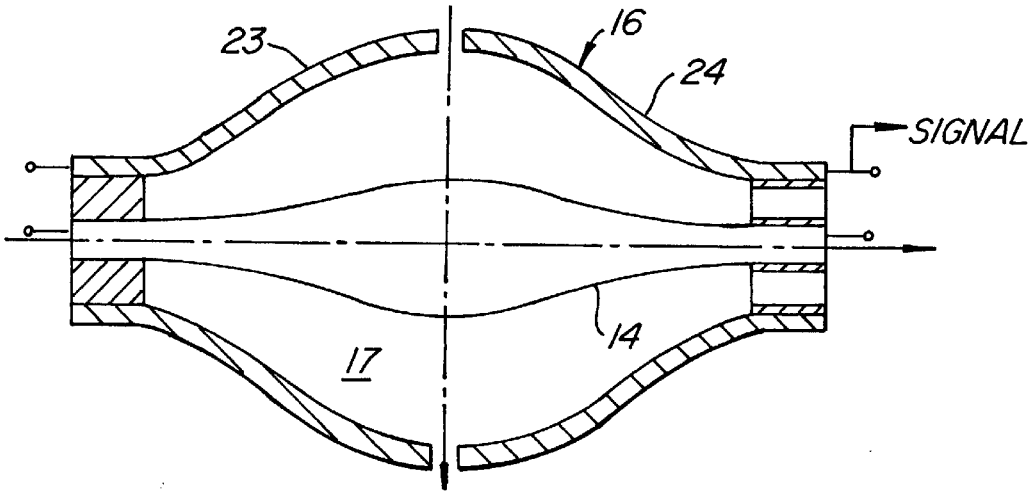
FIG. 2 is a side view to a larger scale of a part of FIG. 1 showing the field generation arrangement and measurement chamber.
Figure 4:
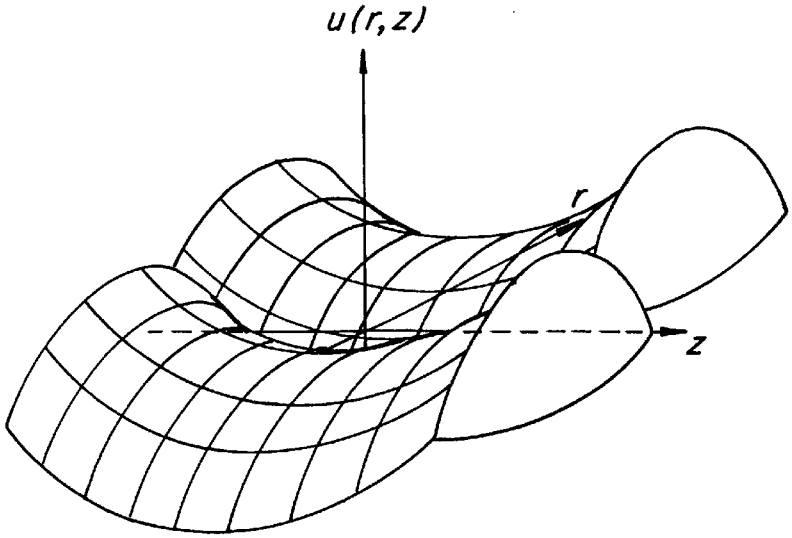
FIG. 4 shows a graphical representation of one form of the potential distribution of the electric field provided by the field generation arrangement.
Figure 5:
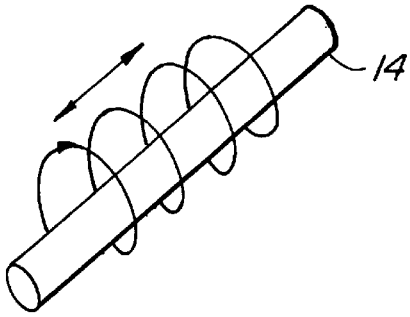
FIG. 5 shows a diagrammatic representation of the movement of trapped ions in the measuring chamber with the electric field of FIG. 4.

The internal and external shaped electrodes 14, 16 when supplied with a voltage will produce respective electric fields which will interact to produce within the measurement chamber 17 a so-called "hyper-logarithmic field". The potential distribution of a hyper-logarithmic field, is shown in FIG. 4 and is described in cylindrical coordinates (r,z) by the following equation:

$$u(r,z)=k/2((z-a)^2-r^2/2)+b\ln(r/c)+d$$

where a, b, c, d and k are constants. It can be seen from this figure that such a field has a potential well along the axial (Z) direction which allows an ion to be trapped within such potential well if it has not enough energy to escape. The field is arranged such that the bottom of the potential in the radial direction (i.e. along axis r in FIG. 4) lies along the longitudinal axis of the measurement chamber 17 shown in FIGS. 1 and 2. While for the purposes of illustration of the present invention a hyper-logarithmic field will be described, it is thought that other forms of field will be capable of being used, the only restriction on the form of field generated being that the field defines in potential terms a three-dimensional well in which ions can be trapped, and ions are prevented from striking an inner electrode by virtue of rotational motion about this electrode.

A suitable detector which may be connected to a microprocessor based circuit is provided which analyzes the signal in accordance with conventional Fourier analysis techniques by detecting one or more of the following frequency characteristics of the ions in the chamber 17, i.e. harmonic motion in its axial direction, oscillation in the radial direction and the frequency of angular rotation. The most appropriate frequency to give the required high performance is the harmonic motion in the axial direction. These frequencies can be detected while the ions are in the measurement chamber 17. The ions may also be detected after they have been ejected from the chamber 17, as desired or as appropriate. Where detection in the measurement chamber 17 is used, it is possible to use one half of the outer electrode 16 as a detector as will be described hereinafter. Each of the electrodes 14, 16 may be split into two or more electrode segments, if desired.

In use, ions to be measured are produced by the ion source 11, focused and accelerated by plates 27–31 and leave the ion source 11 through entrance slit 19.

The ion source 11 is directed towards a tangential inlet aperture (not shown) in the outer cylindrical electrode 21 and the ions enter the injection cavity 32 between the cylindrical electrodes 21, 22 with a small axial velocity component so that the ions move axially away from the inlet. The field produced between the two cylindrical electrodes 21, 22 causes the ions to enter a spiral trajectory around the inner cylindrical electrode 22.

Figure 6:
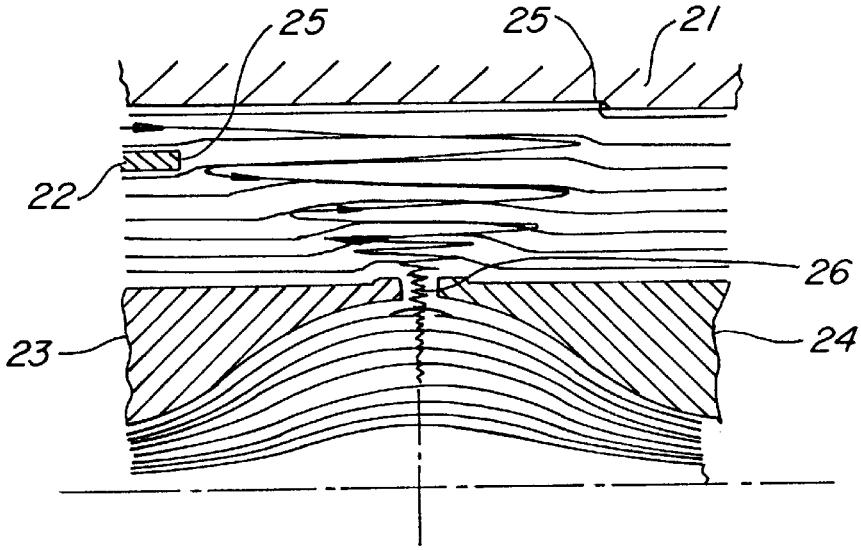
FIG. 6 shows a diagrammatic representation of the movement of ions from the ion injection arrangement to the measuring chamber.
Figure 7:
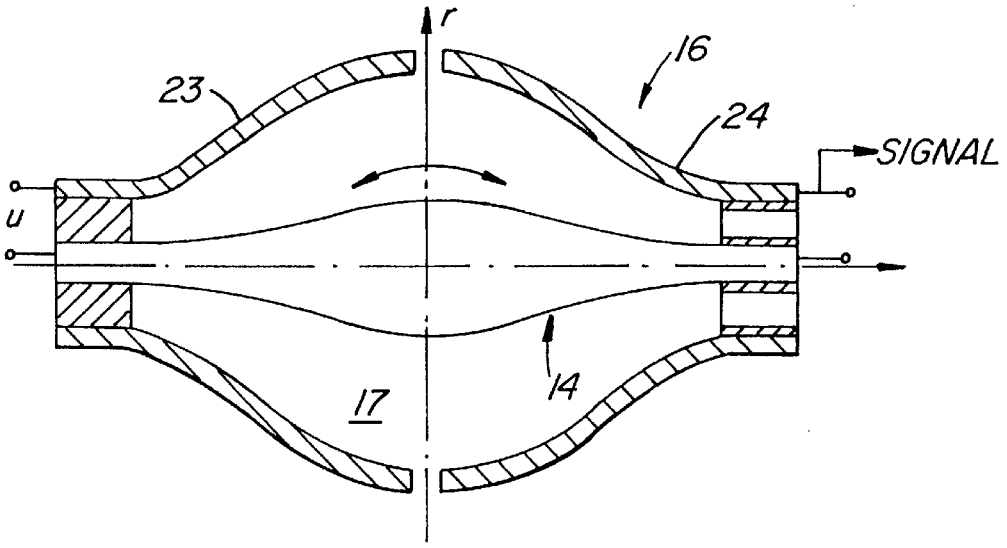
FIG. 7 shows a side view similar, to FIG. 2 illustrating the movement of the ions in a measurement chamber in the axial direction after excitation.

In order to inject the ions from the injection arrangement 12 into the measurement cavity 17, it is necessary to modify the electric field produced by the cylinder electrodes 21, 22 (and 36 where appropriate) to define a potential valley which is directed towards the circumferential gap 26 between the excitation and detection electrode parts 23, 24. In the apparatus of the present invention, this is achieved by providing steps in the cylinder electrode walls 25 which, in combination with the fringing effects caused by the circumferential gap modifies the field in the manner desired. Of course, it may be possible to achieve the same effect using different means as desired or as-appropriate. By increasing the voltage applied to the electrodes 21, 22, 23, 24 with time, the sides of the potential well are increased in gradient thereby forcing the ions to oscillate within the confines of this valley. Furthermore, as the voltage increases, the field intensity increases and therefore the force on the ions towards the longitudinal axis increases thus decreasing the radius of spiral of the ions. Thus it can be seen that the ions converge into the gap 26 by virtue of being forced to rotate in spirals of smaller radius and by a potential well caused by modification of the field produced by the electrodes 21, 22, 23, 24. This is shown schematically in FIG. 6. Of course, the injection arrangement 12 can take any form as desired or as appropriate, for example electrodes 21, 22 need not be present and electrodes 23, 24 can be segmented, and a part of the field can be switched off during injection and switched on again to trap the ions once injection has been completed. The present arrangement has been developed to provide greater sensitivity.

After sufficient ions have been directed into the measurement chamber 17, the voltage supply to spaced electrodes 14, 17 can be maintained constant and the voltage supply to the cylinder electrodes 21, 22 can be changed such that all ions outside the hyper-logarithmic field are lost in the injection arrangement 12.

The shaped electrodes 14, 16 in the field generation arrangement are shaped so as to have the shape of equipotential surfaces in, the required potential distribution. The hyper-logarithmic field is created in the measurement chamber 17 by the electrodes 14, 16 and the ions injected from the injection arrangement 12 through gap 26 are maintained within the potential well in this field so as not to strike inner electrode 14 by ensuring that they have sufficient rotational energy to orbit the electrode 14 in a spiral trajectory. Thus the ions to be analyzed are trapped in the field and are forced to oscillate back and forth within the confines of the well created by the hyper-logarithmic field in a spiral trajectory around the central electrode 14.

Once the ions are trapped in the hyper-logarithmic field, various methods of analysis can be used as are described hereinafter.

After mass analysis has been completed, any remaining ions in the injection or measuring chamber are swept away by, changing the voltage supply to the electrodes 14, 16 for a short time.

Mass analysis can be carried out using the mass spectrometer of the invention in one of two modes which will be considered in turn:

1. Fourier Transform Mode

There are three characteristic frequencies of oscillation within the field. The first is the harmonic motion of the ions in the axial direction where they oscillate in the potential well with a frequency independent of energy in this direction.

The second characteristic frequency is oscillation in the radial direction since not all the trajectories will be perfectly circular.

The third frequency characteristic of the trapped ions is the frequency of angular rotation.

In order to detect the frequencies of oscillations the motion needs to be coherent. The radial and rotational oscillations are not coherent since ions are injected into the measurement cavity 17 continuously over a period of time, and hence the distribution of ions around the inner shaped electrode 14 is random. It is easiest to induce coherence in the axial oscillations and therefore the outer electrode 16 is formed in two parts 23, 24 as described above for this purpose. If a voltage pulse is applied to one part 23 of this electrode, the ions which exist as a disc in the measurement chamber 17 after passing through the gap 26 between the two parts 23, 24, will receive a force toward the other part 23 or 24 in the axial direction. After this pulse the voltages on the two parts 23, 24 can once again be made equal and the ions will then oscillate with harmonic motion in the potential well of the field in the axial direction. One or both parts 23, 24 of the outer shaped electrode 16 is then used to detect image current as the ions oscillate back and forward. The Fourier Transform of the signal from the time domain to the frequency domain can thus produce a mass spectrum in conventional manner. It is in this mode of detection with which high mass resolutions are possible.

2. The Mass-Selective Instability (MSI) Mode

The second mode of mass detection involves ejection of the ions from the potential well in the hyper-logarithmic field and collection on a detector.

This mode of operation is analogous to that used in conventional quadrupole ion traps, but differs greatly in that in this device there is no instability in the radical direction.

Although the principal analysis method used in terms of utilising the important advantages of the present invention would be the Fourier Transform mode, there are certain instances where the MSI mode is useful. For example one mass, can be stored for subsequent MS/MS analysis, by ejecting all other masses from the trap, or high intensity signals from unwanted components can be ejected to improve dynamic range.

In this method, the voltage applied to the electrodes 14, 16 is varied sinusoidally with time as in a quadrupole or quadrupole ion trap device, giving two, possible regimes of mass instability.

a) Parametric Resonance

If the voltage between the inner and outer shaped electrode 14, 16 of the spectrometer is varied sinusoidally, then the equations describing ion motion within the trap are the well-known Mathieu equations. In a complete analogy with the quadrupole or quadrupole ion trap, the solutions of the equations of motion can be expressed in terms of two parameters a and q, and can be represented graphically on a stability diagram.

Figure 8:
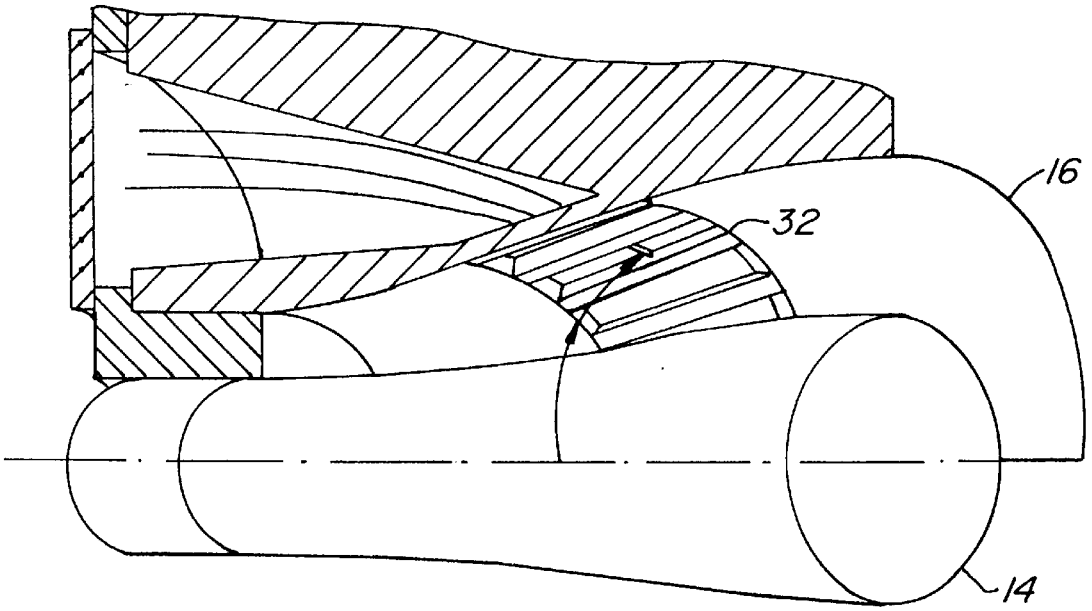
FIG. 8 shows a diagrammatic representation, partly in section, of one form of ion ejector from the measurement chamber in the MSI mode of operation.

Application of the appropriate frequency for a given mass results in excitation of oscillations in the axial direction, and after sufficient excitation results in ejection from the measurement chamber 17. A convenient means of detection of the ions is collision with a conversion dynode 32 in the outer electrode 16 which generates secondary electrons which can be accelerated away to a detector (FIG. 8). The main advantage over the quadrupole ion trap is that the magnitude of the radio frequency voltages required are much lower, which means that the mass range of the spectrometer in this mode is effectively unlimited. The mass range of the quadrupole ion trap in conventional scan mode is limited in practice to a few thousand Daltons as very high voltages (>10,000) are required at high mass whereas only a few tens of volts are required in the spectrometer of the present invention.

With this method there are two types of scanning with regard to mass resolution. The first is a rapid scan mode which provides around unit mass resolution. The second regime utilizes the addition of some anharmonic field perturbations which allow the achievement of very high resolutions but at the expense of scan speed. The slower the scan speed the higher the resolution.

b) Resonant Excitation

In this mode of operation the sinusoidal oscillations are applied to one half 23, 24 of the outer shaped electrode 16 at the resonant axial frequency of a particular mass. As above, both low and high resolution modes of operation are possible. The disadvantage of this mode at low resolution compared to the parametric excitation mode is the presence of a number of side resonances which leads to artefacts. However the resonant excitation mode becomes competitive with the parametric excitation mode at high resolution modes of scanning which make use of anharmonic field perturbations. Again high resolutions are only possible at the expense of scan speed. Whether parametric or resonance excitation is the best MSI mode for high resolution depends on the application in which it is to be used. For example parametric resonance does not show a large dependence on beam width, but resonant excitation provides higher scanning rates at the high resolution due to a faster rate of energy acquisition during excitation.

The main advantage of the spectrometer of the present invention over the prior art type of spectrometers, and in particular the ion Cyclotron Resonance (ICR) specification, is much better detection efficiency at high mass. This arises due to the fact that the signal to noise ratio (S/N) is proportional to the image current frequency in an ICR spectrometer the frequency of oscillation decreases as I/M (M being the mass to charge ratio of the ion). With the spectrometer of the present invention the frequency of oscillation decreases as I/M1/2 and hence decreases much more slowly. Thus the spectrometer of the present invention should realise a 30–100 increase in detection efficiency in the 10–100 k Da range. This high mass capability is important in the application of mass spectrometers to biological compounds.

Comparatively the spectrometer of the present invention has less mass resolution at low masses (>1000) than the ICR specification. This arises due to the higher field accuracy in the ICR spectrometer.

Furthermore, the space charge effects (related to the number of ions and hence dynamic range) which can be tolerated in the spectrometer of the present invention is greater than can be tolerated in an ICR spectrometer. This arises due to the fact that the ions are distributed along a longer trajectory and there is some shielding of the ions from each other due to the presence of the central electrode.

Figure 9A:
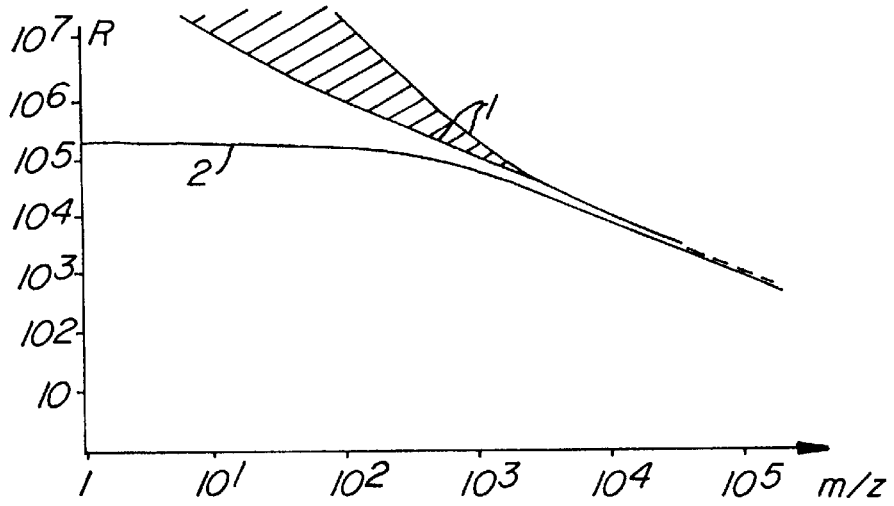
FIG. 9 shows graphical representations of various parameters of a mass spectrometer indicating the performance of the mass spectrometer of the present invention (1) and similar parameters of a conventional ICR mass spectrometer.
Figure 9B:
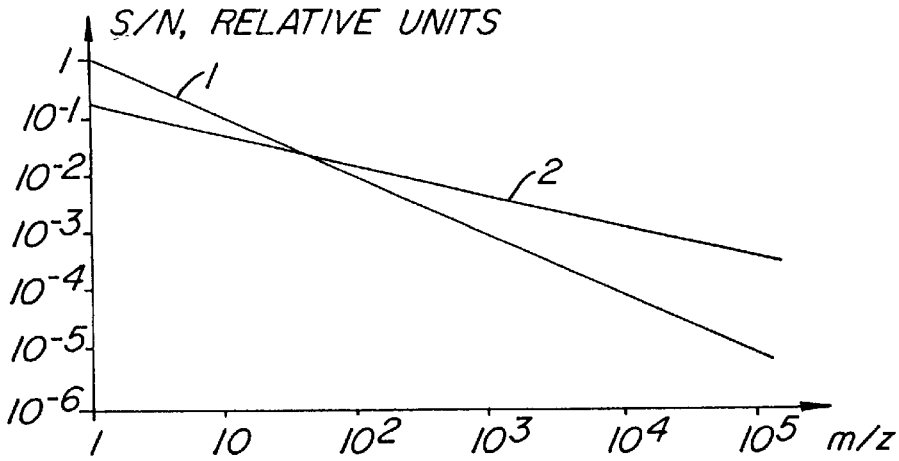
Figure 9C:
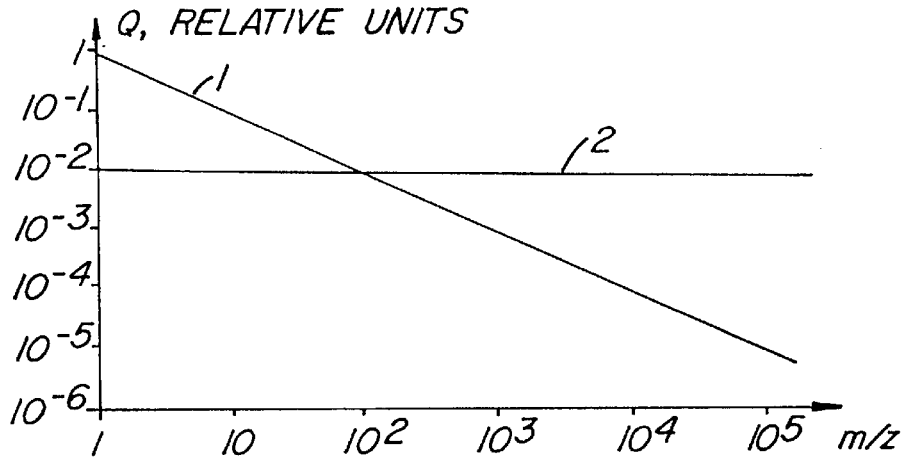

These comparisons are illustrated graphically in FIG. 9 of the drawings.

It will be appreciated that with the arrangement of the present invention, it is possible to provide a mass spectrometer which is relatively simple and inexpensive to produce which allows high resolution measurements to be made.

It is of course to be understood that the invention is not intended to be restricted to the details of the above embodiment which is described by way of example only.

What is claimed is:

1. A mass spectrometer comprising an ion source to produce ions to be analyzed, electric field generation means to produce an electric field within which said ions can be trapped and detection means to detect ions according to their mass/charge ratio wherein said electric field defines a potential well along an axis thereof and said ions are caused to be trapped within said potential well and to perform substantially harmonic oscillations within said well along said axis, said ions having rotational motion in a plane substantially orthogonal to said axis.

2. A mass spectrometer according to claim 1 wherein the electric field generated is of substantially hyper-logarithmic form and is defined by the following equation:

$$U(r,z)=k/_2[(z-a)^2-r^2/2]+b\ln(r/c)+d$$

where r, z are cylindrical coordinates and a, b, c, d, k are constants with c>O and b, k>O.

3. A mass spectrometer according to claim 2 wherein the field generation means comprises a pair of electrodes having a shape defined by the equations $z_1(r)$ and $z_2(r)$ respectively and a potential defined by the equations $U(r,z_1(r))=U_1$ and $U(r,z_2(r))=U_2$.

4. A mass spectrometer according to claim 3 wherein said electrodes are coaxial, one electrode forming an outer electrode and another forming an inner electrode.

5. A mass spectrometer according to claim 3 wherein at least one of said electrodes comprises from at least two sections positioned adjacent each other with a gap therebetween.

6. A mass spectrometer according to claim 1 in which an ion injection arrangement is provided which generates an injection electric field which injects ions into the electric field produced by the field generation means to be trapped therein.

7. A mass spectrometer according to claim 6 wherein the ion injection arrangement comprises electrodes disposed externally of the field generation means so as to surround at least a part of the Field generation means.

8. A mass spectrometer according to claim 7 wherein said ion injection arrangement comprises a pair of coaxial cylinder electrodes.

9. A mass spectrometer according to claim 7 wherein at least one of said electrodes is adapted to modify the injection electric field to produce a potential well into which ions can pass so as to be is directed into the electric field produced by the field generation means to be trapped therein.

10. A mass spectrometer according to claim 9 wherein after passage into the potential well in the injection fields, a voltage applied to the electrodes is varied to reduce the magnitude of oscillations of the ions within the well thereby allowing the ions to be directed into said field generation means through a gap between said electrodes.

11. A mass spectrometer according to claim 7 wherein the injection electric field produced causes ions to follow a spiral trajectory around an inner of said electrodes.

12. A mass spectrometer according to claim 6 wherein said ion source includes acceleration and focusing means to accelerate and focus said ions into said ion injection arrangement.

13. A mass spectrometer according to claim 12 wherein said acceleration and focusing means comprises a plurality of charged plates.

14. A mass spectrometer according to claim 12 wherein after passing through said acceleration and focusing means, ions are directed through a tubular member.

15. A mass spectrometer according to claim 1 wherein the harmonic oscillations of said ions are excited by variation of a voltage applied to said field generation means.

16. A mass spectrometer according to claim 1 wherein said detection means acts to detect said ions by detection of an image current induced on a part of said electrodes.

17. A mass spectrometer according to claim 1 wherein said ions are excited and ejected from said field for detection.

18. A mass spectrometer according to claim 17 when said detection means detects secondary particles produced by collision of ions with at least a portion of said detection means.

19. A mass spectrometer according to claim 18 wherein said detection means comprises a dynode and a secondary electron detector, said ions after being arranged to collide with said dynode thereby to produce secondary electrons, said secondary electrons being detected by said detector.

20. A mass spectrometer according to claim 1 further including fragmentation means which is operable to split said ions produced by said ion source into smaller ions thereby allowing the spectrometer to operate in MS/MS configuration.

21. A mass spectrometer according to claim 20 wherein said fragmentation means is operable to fragment selected said ions when trapped in said electric field, non-selected ions being ejected from said field.

22. A mass spectrometer according to claim 1 further comprising at least one of electrodes having at least two sections positioned adjacent each other with a gap there between, and an ion injection arrangement which is provided to generate an injection electric field that injects ions into the electric field produced by the field generation means to be trapped therein, and wherein said ion injection arrangement is operable to inject ions into the field produced by said field generation means through said gap in said electrodes.

* * * * *